US007195571B2

(12) United States Patent
Nye

(10) Patent No.: US 7,195,571 B2
(45) Date of Patent: Mar. 27, 2007

(54) COLLAPSIBLE BASKETBALL RIM ASSEMBLY

(75) Inventor: S. Curtis Nye, Clinton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 10/357,655

(22) Filed: Feb. 3, 2003

(65) Prior Publication Data

US 2003/0153414 A1 Aug. 14, 2003

Related U.S. Application Data

(60) Provisional application No. 60/354,462, filed on Feb. 4, 2002.

(51) Int. Cl.
*A63B 63/08* (2006.01)

(52) U.S. Cl. ..... 473/485; 473/479

(58) Field of Classification Search ..... 473/485, 473/476, 479, 481, 482, 483, 484, 486, 487–489; 16/247, 248, 260, 270, 390–392; 248/291.1, 248/130, 240.3; D21/701–705
See application file for complete search history.

(56) References Cited

U.S. PATENT DOCUMENTS

| | | | | |
|---|---|---|---|---|
| 1,157,333 | A | 10/1915 | Snell | |
| 1,387,418 | A | 8/1921 | Lillibridge | |
| 1,549,660 | A | 8/1925 | Ericson | |
| 1,573,246 | A * | 2/1926 | Holland | 248/240.3 |
| 2,596,543 | A | 5/1952 | Fox | |
| 3,025,058 | A | 3/1962 | Brumfield | |
| 3,375,004 | A | 3/1968 | Ebstein | |
| 3,603,588 | A * | 9/1971 | Ebstein | 473/485 |
| 3,788,642 | A * | 1/1974 | Matras et al. | 473/481 |
| 3,820,784 | A * | 6/1974 | Boitano et al. | 473/481 |
| 4,111,420 | A | 9/1978 | Tyner | |
| 4,320,896 | A | 3/1982 | Engle et al. | |
| 4,377,283 | A | 3/1983 | Mahoney | |
| 4,438,923 | A | 3/1984 | Engle et al. | |
| 4,441,709 | A | 4/1984 | Schroeder et al. | |
| 4,575,079 | A * | 3/1986 | De Faveri | 473/486 |
| 4,583,732 | A | 4/1986 | Allen | |
| 4,588,188 | A | 5/1986 | Mahoney et al. | |
| 4,653,646 | A | 3/1987 | Allen et al. | |

(Continued)

*Primary Examiner*—Eugene Kim
*Assistant Examiner*—M. Chambers
(74) *Attorney, Agent, or Firm*—Workman Nydegger

(57) ABSTRACT

A basketball rim assembly for use with a basketball system is disclosed. Desirably, the basketball rim assembly is movable between a collapsed position and a use or playing position. The basketball rim assembly may include a rim, an upper back plate connected to the rim, a brace connected to the rim, and a lower back plate connected to the brace. The lower back plate is preferably positioned proximate the upper back plate when the basketball rim assembly is in the collapsed position and the lower back plate is spaced apart from the upper back plate when the basketball assembly is in the use position. The basketball rim assembly may also include a connecting member that connects the upper back plate to the rim and a mounting plate that is sized and configured to be connected to the upper back plate and the lower back plate. The basketball rim assembly may also include a basketball backboard disposed between the upper back plate and the mounting plate, or a basketball backboard that is attached directly to the upper back plate and the lower back plate.

25 Claims, 4 Drawing Sheets

U.S. PATENT DOCUMENTS

| | | | |
|---|---|---|---|
| 4,676,503 | A | 6/1987 | Mahoney |
| 4,723,777 | A | 2/1988 | Jolly |
| 4,826,162 | A | 5/1989 | Allen |
| 4,846,469 | A | 7/1989 | Nye |
| 4,895,365 | A | 1/1990 | Schroeder |
| 5,098,108 | A | 3/1992 | McKinney |
| 5,106,084 | A | 4/1992 | Vaught |
| 5,248,140 | A | 9/1993 | Mower et al. |
| 5,255,910 | A | 10/1993 | Simonseth |
| 5,318,289 | A | 6/1994 | Mahoney et al. |
| 5,374,055 | A | 12/1994 | Tung |
| 5,415,393 | A | 5/1995 | Fitzsimmons et al. |
| D362,881 | S | 10/1995 | Schickert et al. |
| 5,464,207 | A | 11/1995 | Boitano |
| 5,489,107 | A | 2/1996 | Kho |
| 5,586,759 | A | 12/1996 | Fitzsimmons et al. |
| 5,730,668 | A | 3/1998 | Hege et al. |
| D399,895 | S | 10/1998 | Schickert et al. |
| 5,816,955 | A | 10/1998 | Nordgran et al. |
| 5,830,090 | A | 11/1998 | Fitzsimmons et al. |
| 5,947,847 | A | 9/1999 | Van Nimwegen et al. |
| 6,186,911 | B1 | 2/2001 | Manthey |
| 6,412,747 | B2 | 7/2002 | Davis et al. |
| 6,432,003 | B1 | 8/2002 | Van Nimwegen et al. |
| 6,673,413 | B1 * | 1/2004 | Kincel et al. ..... 428/99 |

* cited by examiner

COLLAPSIBLE BASKETBALL RIM ASSEMBLY

CROSS-REFERENCE TO RELATED APPLICATIONS

This patent application claims priority to and the benefit of U.S. Provisional Patent Application Ser. No. 60/354,462, entitled Collapsible Basketball Rim, which was filed on Feb. 4, 2002, and which is hereby incorporated by reference in its entirety.

BACKGROUND OF THE INVENTION

1. Field of the Invention

The present invention is generally related to a basketball goal system and, in particular, to a collapsible basketball rim that can be used with a basketball goal system.

2. Description of Related Art

As the game of basketball has increased in popularity, a large number of people have purchased basketball systems for use at their homes. For example, consumers may be able to purchase basketball systems directly from the manufacturer. The cost to ship the basketball system from the manufacturer to the consumer, however, is often very significant because conventional basketball systems are large and bulky. In particular, conventional basketball systems typically include a backboard that has a width of at least 36 inches, a basketball rim or hoop, a support pole to support the backboard and rim ten (10) feet above a playing surface, and a base to support the basketball system. The base may be part of a portable basketball system that allows the system to be moved or transported. The base may also be part of an in-ground or permanent basketball system. These components require a large amount of space, which requires a large shipping container, and that increases the costs to ship the basketball system to the consumer.

Conventional basketball systems are marketed to consumers through retail stores such as sporting goods stores. The cost to ship these conventional basketball systems to retail stores is also quite significant because of the large size of the systems. In addition, the manufacturer and retail stores often store a number of basketball systems and the large size of the packaging makes storing the systems very difficult. For example, if the basketball system is packaged in a large box, then the large size of the box may prevent stacking more than a few of the systems in a single stack. Additionally, the large box size may prevent more than a few of the basketball systems from being stored on conventional shelving. The large size of the box may also discourage or prevent many consumers from purchasing the basketball system. For example, the difficulty in moving the box within the store to the checkout stand, transporting the basketball system to the consumer's home, and then positioning the basketball system in the desired location at the home may discourage or prevent consumers from purchasing a conventional basketball system.

It is also known to ship conventional basketball systems in customized packaging. The awkward shapes and sizes of the customized packaging, however, may prevent efficient storage and transport of the basketball systems. For example, irregularly shaped boxes typically cannot be stacked or stored in a warehouse or shipping container without creating a large amount of unused and wasted spaced. The irregularly shaped boxes may also be very difficult, if not impossible, to effectively stack or align. In addition, because the packaging is not standard, conventional shelves and shipping containers may not efficiently store or receive the packaging. Further, the customized packaging generally increases the cost of the basketball system because customized packaging is typically more expensive than conventional packaging.

Conventional basketball systems may also package the rim and backboard in one box or package, and the pole and base in another package. Disadvantageously, this requires shipping and handling of two separate packages, and also requires the retailer to stock two separate items, as well as requiring the consumer to carry home two separate packages. Shipping the basketball system in two different packages also increases the difficulty in tracking the packages, increases the chances that a package may be lost or stolen, and shipping two separate packages is often more expensive that shipping a larger single package.

The basketball rim used in connection with conventional basketball systems is particularly difficult to pack and ship because the large circular rim requires a large amount of space. Conventional basketball rims have an inside diameter of 18 inches and a back plate is attached at a 90° angle to the rear portion of the rim. The back plate typically has a length of at least four (4) inches and it extends generally perpendicular from the plane containing the rim. This creates a generally "L"-shaped structure that is difficult to package and the rim typically creates a large unused space within the packaging.

In order to decrease the size of the packaging, a recess that is sized and configured to receive the back plate of the rim may be formed in the base of conventional portable basketball systems. In particular, portable basketball systems often include a base that can be filled with ballast materials such as sand or water in order to maintain the basketball system in a generally stationary or fixed position while playing the game of basketball. The base is typically constructed from plastic and it has a large size to contain the desired amount of ballast material. It is known to create a recess in the ballast filled base and the rim back plate is stored within the recess when the basketball system is being shipped. Undesirably, the recess reduces the volume of the ballast filled base and that limits the amount of ballast material that can be placed in the base. The recess also increases the cost and difficulty to manufacture the base.

BRIEF SUMMARY OF THE INVENTION

A need therefore exists for a basketball rim assembly that eliminates the above-described disadvantages and problems.

One aspect of the present invention is a basketball rim assembly that can be moved between a collapsed position and a use or playing position. Advantageously, the basketball rim assembly can be shipped in the collapsed position and then moved into the use position when it is desired to assemble and use the rim. Significantly, the collapsible basketball rim may decrease the size of the packaging required to ship the basketball rim. In addition, if the collapsible basketball rim is part of a basketball goal system, then it may decrease the size of the packaging required to ship the basketball system. In addition, the collapsible rim may allow for more efficient storage and transport of the basketball rim and/or basketball goal system because the size of the packaging may be reduced.

Another aspect of the collapsible basketball rim assembly is the rim can be quickly and easily moved from the collapsed position to the use or playing position. This allows the rim assembly to be transported or shipped in the collapsed position and then quickly and easily connected to a basketball backboard or support structure. Significantly, the consumer or retailer may easily move the basketball rim from the collapsed position to the use position to allow a basketball system to be assembled.

Still another aspect of the collapsible basketball rim assembly is the assembly may include a hoop or rim, a connecting member that connects an upper back plate to the rim, and one or more braces that connect a lower back plate to the rim. In the collapsed position, the upper back plate and the lower back plate are disposed near or adjacent to each other to decrease the height of the rim assembly. In the use or playing position, the upper back plate and lower back plate are separated by a distance which allows the rim to be attached to a mounting plate, backboard, support structure and/or other suitable structure.

Advantageously, the reduction in the size of the back plate allows the package for shipping the rim to be a smaller and more conventional size. Additionally, if the collapsible basketball rim assembly is part of a basketball system, such as a portable basketball system, then the packaging size of the basketball system may be reduced. Further, a recess does not have to be formed in the ballast filled base for a portable basketball system to receive the back plate of the rim. Significantly, the collapsible basketball rim assembly allows the size of the packaging to be decreased, but the collapsible basketball rim preferably functions in a similar manner to a conventional basketball rim.

Another aspect is a basketball rim assembly that is movable between a collapsed position and a use position. The basketball rim assembly preferably includes a rim, an upper back plate connected to the rim, at least one brace connected to the rim, and a lower back plate connected to the brace. The lower back plate is positioned proximate the upper back plate when the basketball rim assembly is in the collapsed position and the lower back plate is spaced apart from the upper back plate when the basketball assembly is in the use position. The basketball rim assembly may also include a connecting member that connects the upper back plate to the rim and a mounting plate that is sized and configured to be connected to the upper back plate and the lower back plate. The basketball rim assembly may also include a basketball backboard disposed between the upper back plate and the mounting plate.

Yet another aspect is a basketball rim assembly including a rim, a connecting member attached to the rim, a brace including a first portion that is attached to the rim and a second portion that extends away from the rim, and a mounting plate that is sized and configured to be attached to the upper back plate and the brace. The brace is preferably movable between a collapsed position in which the second portion of the brace is disposed proximate the upper back plate and a use position in which the second portion of the brace is spaced apart from the upper back plate. The basketball rim assembly may also include a groove in the mounting plate that is sized and configured to receive the second portion of the brace when the brace is in the second position. In addition, the basketball rim assembly may include a lower back plate that is connected to the second portion of the brace. Further, the basketball rim assembly may include a basketball backboard with one or more upper mounting holes and one or more lower mounting holes, and one or more mounting holes in the upper back plate and one or more mounting holes in the lower back plate. Desirably, the upper mounting holes in the basketball backboard are configured to be aligned with the mounting holes in the upper back plate and the lower mounting holes in the basketball backboard are configured to be aligned with the mounting holes in the lower back plate when the basketball rim assembly is in the playing position.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

The present invention is directed towards a collapsible basketball rim assembly. The principles of the present invention, however, are not limited to a collapsible basketball rim assembly. It will be understood that, in light of the present disclosure, the collapsible basketball rim assembly disclosed herein can be successfully used in connection with other types of basketball and sporting equipment. For instance, the collapsible basketball rim assembly may be used in connection with breakaway type basketball rims or basketball type games that do not comply with the conventional type basketball rules or standards.

Additionally, to assist in the description of the collapsible basketball rim assembly, words such as top, bottom, front, rear, right and left are used to describe the accompanying figures. It will be appreciated, however, that the basketball rim assembly can be located in a variety of desired positions—including various angles, sideways and even upside down. A detailed description of the basketball rim assembly now follows.

Figure 1:
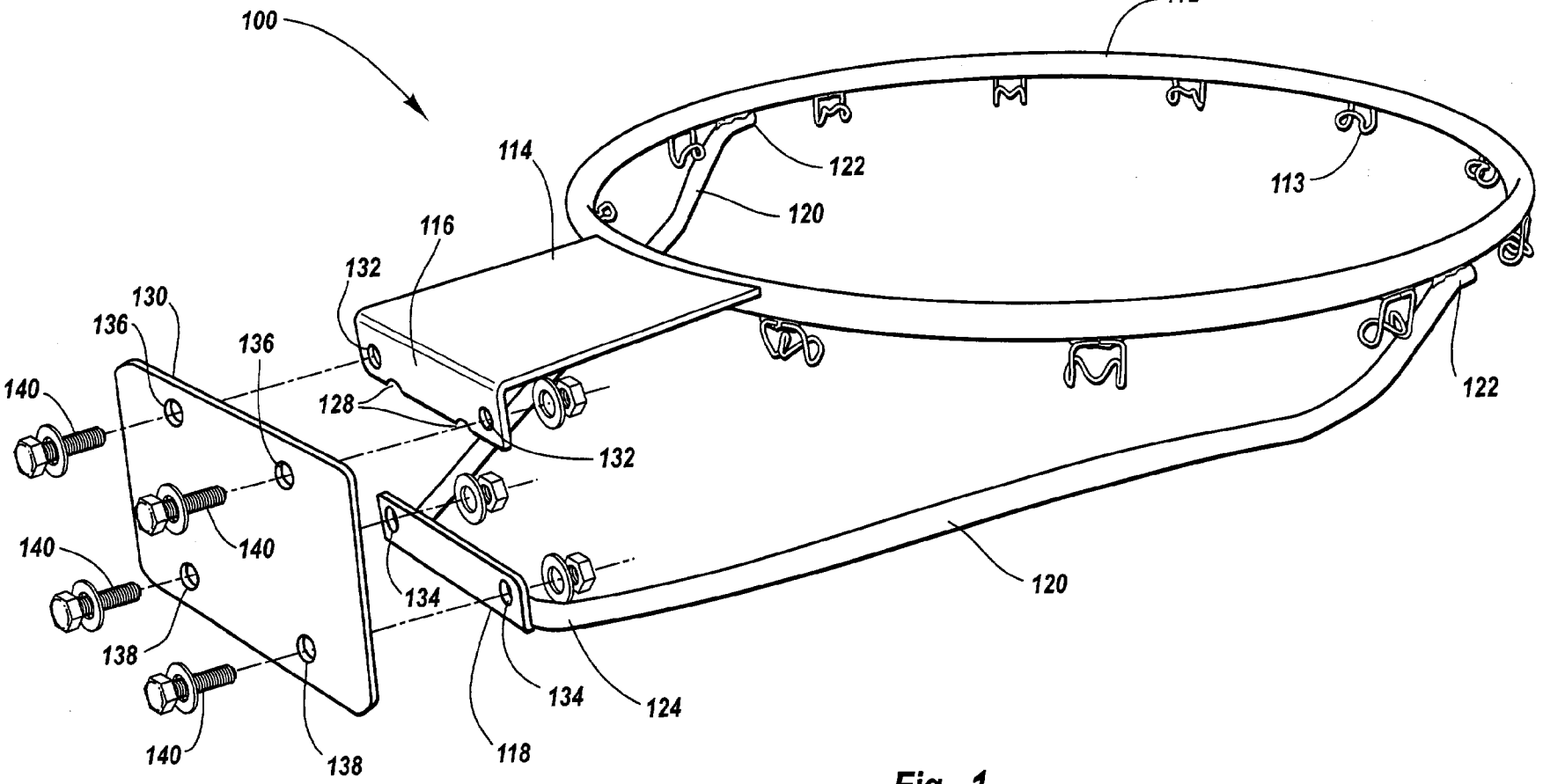
FIG. 1 is an exploded perspective view of a collapsible basketball rim assembly in accordance with a preferred embodiment of the present invention.

As seen in FIG. 1, a basketball rim assembly 100 includes a rim or hoop 112, a connecting member 114, an upper back plate 116, a lower back plate 118, and one or more braces 120. The rim 112 is preferably a conventional sized basketball rim and it includes a number of ringlets 113 that allow a net (not shown) to be attached to the rim. The connecting member 114 is attached to a rear portion of the rim 112 and the connecting member 114 has a generally planar upper surface that is generally aligned with the upper surface of the rim 112. The connecting member 114 is preferably securely attached to the rim 112 by welding, but any suitable means or devices may be used to attach the connecting member 114 to the rim 112. The connecting member 114 is preferably sized and configured to position the rim 112 a desired distance from a backboard (not shown).

The upper back plate 116 is attached to the connecting member 114 opposite the rim 112. The upper back plate 116 may be a separate component that is attached to the connecting member 114 or the upper back plate may be an integral part of the connecting member, such as a flange or other downwardly extending portion. As shown in the accompanying figures, the upper back plate 116 is preferably disposed generally perpendicular to the upper surface of the connecting member 114, but the upper back plate 116 could be disposed at any suitable angle depending, for example, upon the configuration or intended use of the basketball rim assembly 100. In particular, the upper back plate 116 may also extend upwardly from the connecting member 114 if desired.

As shown in FIG. 1, the basketball rim assembly 100 may include two separate braces 120 that connect the lower back plate 118 to the rim 112. In particular, each of the braces 120 includes a first end 122 that is welded or otherwise connected to the rim 112. The braces 120 also include a second end 124 that is welded or otherwise connected to the lower back plate 118. Advantageously, the braces 120 help support the rim 112 during the game of basketball. In addition, the braces 120 attach the lower back plate 118 to the rim 112. One skilled in the art will appreciate that only a single brace, which may have a generally U-shaped configuration as shown and described in connection with FIGS. 4 and 5, or more than two braces may be used to attach the lower back plate 118 to the rim 112.

The braces 120 are preferably sized and configured to allow the positioning of the lower back plate 118 to be adjusted or moved relative to the upper back plate 116. For example, the braces 120 may be constructed from a material that is malleable or bendable to allow the movement of the lower back plate 118 relative to the upper back plate 116. The connection of the braces 120 to the rim 112 may also allow the lower back plate 118 to move. One skilled in the art will appreciate that other suitable mechanisms or means that allow the relative positioning of the upper and lower back plates 116, 118 to be adjusted may also be used.

Figure 2:
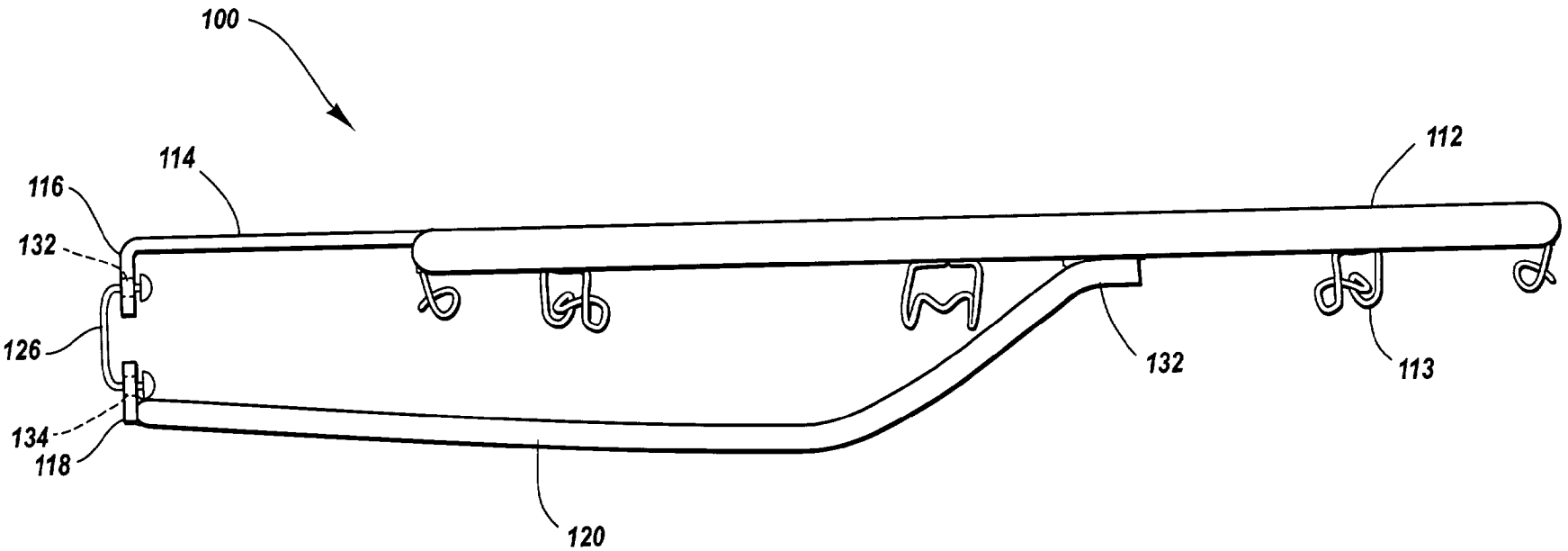
FIG. 2 is a side view of the collapsible basketball rim assembly shown in FIG. 1, illustrating the rim in a collapsed position and a fastener connecting the upper back plate and the lower back plate.

In greater detail, the lower back plate 118 is movable relative to the upper back plate 116 between a use position as shown in FIG. 1 and a collapsed position as shown in FIG. 2. In the use position, the basketball rim assembly 100 may be configured to be attached to a backboard or support assembly to allow a basketball goal to be assembled and the game of basketball to be played. In the use position, the upper back plate 116 and the lower back plate 118 are separated by a given distance such as one or two inches, or more. It will be understood that the distance separating the upper and lower back plates 116, 118 may depend, for example, upon the configuration of the basketball rim 112 or the intended use of the rim assembly 100. In the collapsed position shown in FIG. 2, the basketball rim assembly 100 is configured to be shipped, packaged or otherwise transported. In greater detail, the upper back plate 116 and the lower back plate 118 are positioned near or proximate each other in the collapsed position. In fact, all or a portion of the upper back plate 116 and lower back plate 118 may overlap or be positioned adjacent to each other when the rim assembly 100 is in the collapsed position. The upper and/or lower back plates 116, 118 may include one or more grooves or notches, such as notches 128 in the upper back plate, that may be sized and configured to receive and/or engage the opposing back plate.

As shown in FIG. 2, when the basketball rim assembly 100 is in the collapsed or shipping position, the lower back plate 118 is located near or adjacent to the upper back plate 116. Advantageously, the collapsed position significantly decreases the height or profile of the basketball rim assembly 100, which allows the rim assembly to be packaged within a smaller space for shipping. This may allow, for example, a standard sized shipping container to be used or if the rim assembly 100 is part of a portable basketball system, then the overall size of the system may be decreased. As shown in FIG. 2, a pin or other type of fastener 126 may be used to hold the upper and lower back plates 116, 118 in the collapsed position.

Advantageously, the basketball rim assembly 100 may be quickly moved between the collapsed position and the playing position by moving the lower back plate 118 towards the upper back plate 116. This not only allows the basketball rim assembly 100 to be quickly assembled, it may also allow the rim assembly to be quickly disassembled. Additionally, tools are preferably not required to move the rim assembly 100 between the collapsed and playing positions, but tools could be used if desired.

Figure 3:
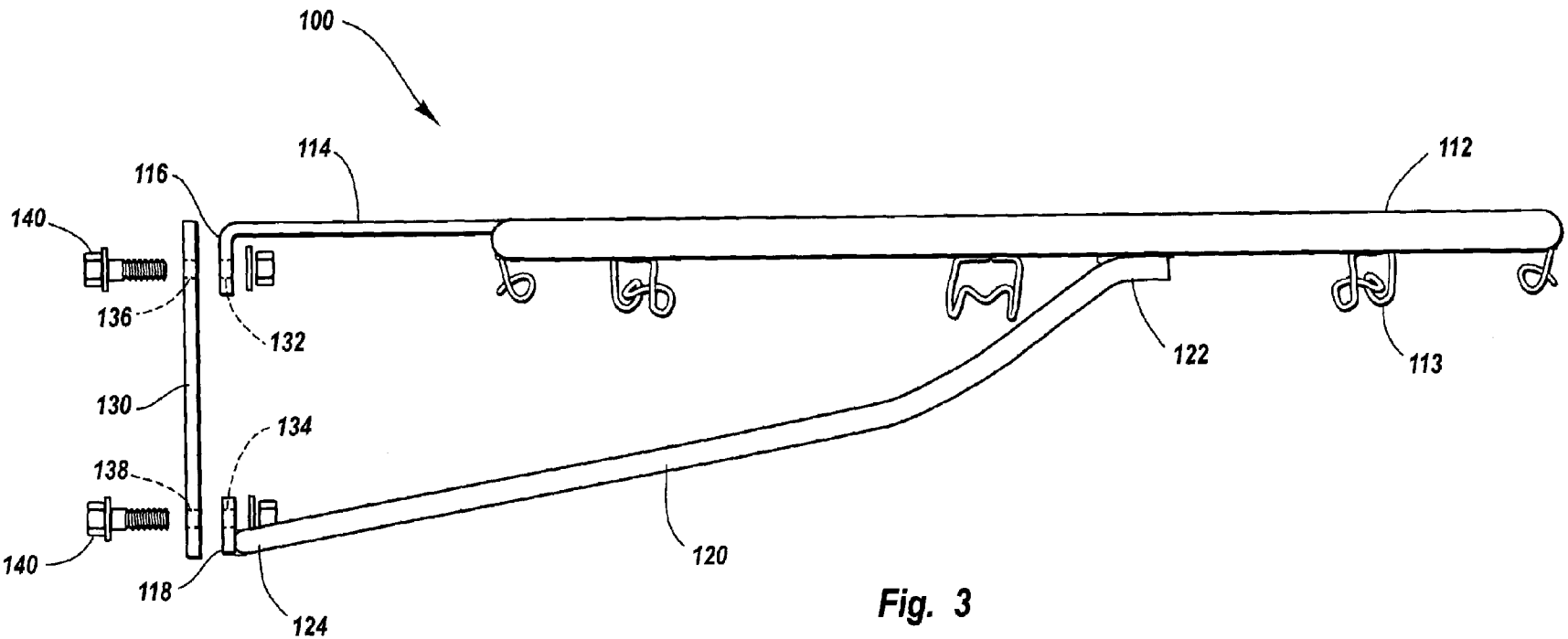
FIG. 3 is a side view of the collapsible basketball rim assembly shown in FIG. 1, illustrating the rim in a use or playing position and being configured to be connected to a mounting plate.

As best seen in FIGS. 1 and 3, when the rim assembly 100 is in the use or playing position, the upper and lower back plates 116, 118 are separated a given distance and preferably aligned in generally the same plane. This allows the upper and lower back plates 116, 118 to be quickly and easily attached to a mounting plate 130. Preferably, the upper and lower back plates 116, 118 are connected to the mounting plate 130 by fasteners such as bolts. In particular, the upper back plate 116 preferably includes two openings or holes 132 and the lower back plate 118 preferably includes two openings or holes 134. The mounting plate 130 includes a corresponding pair of upper openings or holes 136 and a corresponding pair of lower openings or holes 138. The upper openings 136 in the mounting plate 130 are generally aligned with the openings 132 in the upper back plate 116 and the lower openings 138 in the mounting plate are generally aligned with the openings 134 in the lower back plate 118 when the rim assembly 100 is in the use or playing position. Fasteners such as bolts 140 are inserted through the aligned openings to attach the mounting plate 130 to the upper and lower back plates 116, 118. One skilled in the art will appreciate that any suitable type of fasteners, adhesives and the like may be used to connect the mounting plate 130 and the back plates 116, 118; and any suitable number and/or configuration of fasteners may be used to connect the mounting plate and the back plates.

One skilled in the art will understand that a basketball backboard may be positioned between the upper and lower back plates 116, 118 and the mounting plate 130. For example, the backboard may include holes or openings that correspond to the holes and openings in the upper and lower back plates 116, 118 and the mounting plate 130. A support structure such as a support pole may also be placed between the upper and lower back plates 116, 118 and the mounting plate 130. The support structure may be used to position the rim assembly 100 above the playing surface. It will be understood that while a backboard, support structure and/or other suitable components may be positioned between the upper and lower back plates 116, 118 and the mounting plate 130, the mounting plate may be directly connected to the upper and lower back plates.

As discussed above, the mounting plate 130 is preferably a metal plate with openings 136, 138 that correspond to the openings 132, 134 in the upper and lower back plates 116, 118. The mounting plate 130 may also consist of two or more brackets with openings that correspond to the openings 132, 134 in the upper and lower back plates 116, 118. It will be appreciated that the shape of the mounting plate 130 may vary, for example, depending upon the configuration of the upper and lower back plates 116, 118 or the backboard.

The mounting plate 130 may also have various geometries and/or configurations that are designed to engage the upper and lower back plates 116, 118. For example, the mounting plate 130 may have upper and lower recessed sections that correspond to the shape of the upper and lower back plates 116, 118. The upper and lower back plates 116, 118 may be received within the recesses, for example, by a snap, friction or interference fit to attach the back plates to the mounting plate. One skilled in the art will appreciate that other suitable types of fasteners, arrangements, devices and the like may be used to connect the back plates 116, 118 and the mounting plate 130.

The mounting plate 130 may be a separate member, as illustrated in FIGS. 1 and 3, or the mounting plate may be part of another structure such as a backboard or support structure. For example, the backboard could include openings that correspond to the upper and lower openings 136, 138 in the mounting plate 130. This may further decrease the time and effort required to assemble a basketball goal.

Figure 4:
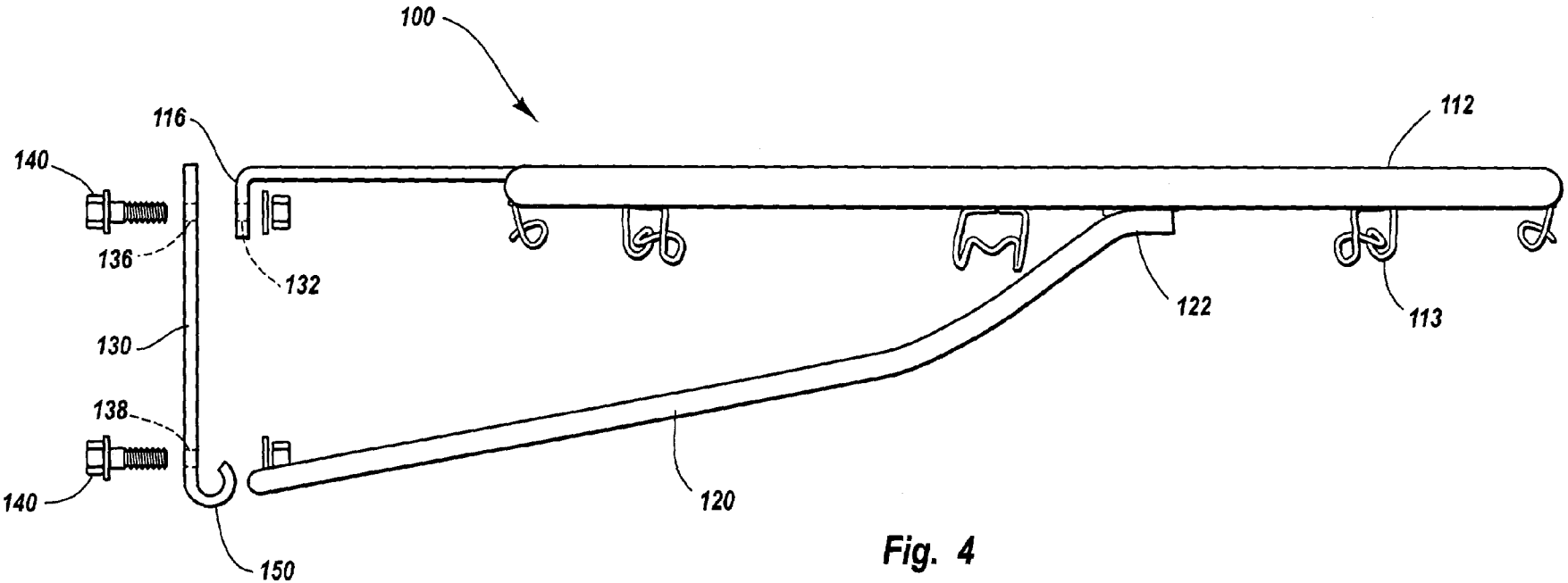
FIG. 4 is side view of a collapsible basketball rim assembly in accordance with another preferred embodiment of the invention, illustrating a mounting plate with a generally "J"-shaped channel.
Figure 5:
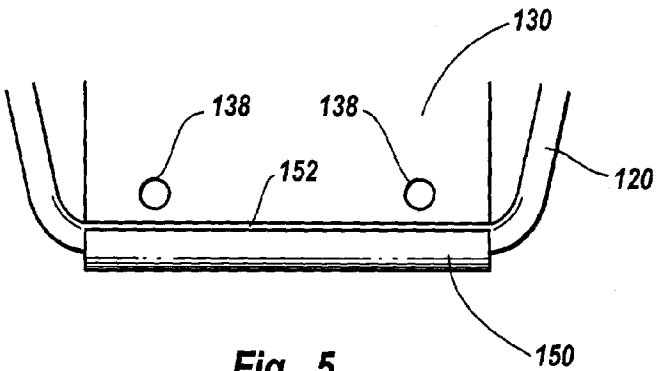
FIG. 5 is a top view of a portion of the collapsible basketball rim assembly shown in FIG. 4, illustrating a brace positioned in the generally "J"-shaped channel of the mounting plate.

As seen in FIGS. 4 and 5, the mounting plate 130 may also include a lip or groove 150 that is sized and configured to receive the brace 120. In particular, the brace 120 may consist of a generally U-shaped member with the ends of the brace attached to the rim 112. The brace 120 also includes an elongated portion 152 that is sized and configured to be received within the groove 150. The brace 120 is preferably securely held within the groove 150 by a snap, friction or interference fit, but any suitable type of device or configuration may be used to retain the brace within the groove.

One skilled in the art will appreciate that other suitable configurations and arrangements of the upper and lower back plates 116, 118, braces 120 and mounting plate 130 may also be used to construct the basketball rim assembly 100. For example, one or more hinges may be used to connect the upper and lower back plates in order to allow the back plates to be placed in a folded position when the rim assembly is in the collapsed position. Other types of bendable or compliant materials may also be used to connect the upper and lower back plates.

Additionally, while the accompanying figures show the upper back plate 116 and the lower back plate 118 as being similarly shaped members and having generally straight edges, other variations are possible. For example, other shapes and configurations may be provided to maintain the rim assembly 100 in the shipping position or to further reduce the storage area of the rim assembly.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A basketball rim assembly that is movable between a collapsed position and a use position, the basketball rim assembly comprising:

a rim;

a connecting member including a first portion and a second portion, the first portion being connected to the rim;

an upper back plate extending downwardly at approximately a 90° angle and being disposed in a generally fixed position relative to the connecting member when the basketball assembly is in the use position and when the basketball assembly is in the collapsed position;

at least one brace connected to the rim; and a lower back plate securely connected in a generally fixed position to the at least one brace when the basketball assembly is in the use position and when the basketball assembly is in the collapsed position, the lower back plate being positioned proximate the upper back plate when the basketball rim assembly is in the collapsed position and the lower back plate being spaced apart from the upper back plate when the basketball assembly is in the use position, the lower back plate being generally aligned in the same plane with the upper back plate when the basketball assembly is in the collapsed position and when the basketball assembly is in the use position, the lower back plate being sized and configured to be connected to the upper back plate in the collapsed position by a fastener to secure the lower back plate in the collapsed position.

2. The basketball rim assembly as in claim 1, further comprising a mounting plate that is sized and configured to be connected to the upper back plate and the lower back plate.

3. The basketball rim assembly as in claim 2, further comprising one or more mounting holes in the upper back plate and one or more mounting holes in the lower back plate; and further comprising one or more upper mounting holes in the mounting plate and one or more lower mounting holes in the mounting plate, the upper mounting holes in the mounting plate being configured to be aligned with the mounting holes in the upper back plate and the lower mounting holes in the mounting plate being configured to be aligned with the mounting holes in the lower back plate when the basketball rim assembly is in the use position.

4. The basketball rim assembly as in claim 2, further comprising a basketball backboard disposed between the upper back plate and the mounting plate.

5. The basketball rim assembly as in claim 1, wherein the at least one brace includes a brace with a first end that is connected to the rim and a second end that is connected to the lower back plate.

6. The basketball rim assembly as in claim 1, wherein the at least one brace includes a single brace with a generally U-shaped configuration.

7. The basketball rim assembly as in claim 1, further comprising a basketball backboard with one or more upper mounting holes and one or more lower mounting holes; and further comprising one or more mounting holes in the upper back plate and one or more mounting holes in the lower back plate, the upper mounting holes in the basketball backboard being configured to be aligned with the mounting holes in the upper back plate and the lower mounting holes in the basketball backboard being configured to be aligned with the mounting holes in the lower back plate when the basketball rim assembly is in the use position.

8. A basketball rim assembly that is movable between a collapsed position and a use position, the basketball rim assembly comprising:

a rim;

a connecting member attached to the rim, the connecting member including an upper back plate that extends downwardly at approximately a 90° angle and is disposed in a generally fixed position relative to the connecting member when the basketball assembly is in the use position and when the basketball assembly is in the collapsed position;

a brace including a first portion that is attached to the rim and a second portion that extends away from the rim, the second portion of the brace including a lower back plate that is secured in a generally fixed position relative to the brace, the upper back plate and the lower back plate being generally aligned in the same plane when the basketball assembly is in the use position and when the basketball assembly is in the collapsed position; and a mounting plate that is sized and configured to be attached to the upper back plate and the lower back plate;

wherein the brace is movable between a collapsed position in which the lower back plate is disposed proximate the upper back plate and a use position in which the lower back plate is spaced apart from the upper back plate, the lower back plate being connected to the second portion of the brace when the brace is in the collapsed position and when the brace is in the use position, the lower back plate being sized and configured to be connected to the upper back plate in the collapsed position by a fastener to secure the lower back plate in the collapsed position.

9. The basketball rim assembly as in claim 8, further comprising one or more mounting holes in the upper back plate and one or more mounting holes in the lower back plate; and further comprising one or more upper mounting holes in the mounting plate and one or more lower mounting holes in the mounting plate, the upper mounting holes in the mounting plate being configured to be aligned with the mounting holes in the upper back plate and the lower mounting holes in the mounting plate being configured to be aligned with the mounting holes in the lower back plate when the basketball rim assembly is in the use position.

10. The basketball rim assembly as in claim 8, wherein the brace has a generally U-shaped configuration.

11. The basketball rim assembly as in claim 8, further comprising a basketball backboard disposed between the upper back plate and the mounting plate.

12. The basketball rim assembly as in claim 8, further comprising a basketball backboard with one or more upper mounting holes and one or more lower mounting holes; and further comprising one or more mounting holes in the upper back plate and one or more mounting holes in the lower back plate, the upper mounting holes in the basketball backboard being configured to be aligned with the mounting holes in the upper back plate and the lower mounting holes in the basketball backboard being configured to be aligned with the mounting holes in the lower back plate when the basketball rim assembly is in the use position.

13. A collapsible basketball rim assembly comprising:

a rim;

a connecting member connected to the rim;

an upper mounting portion extending downwardly at approximately a 90° angle and being connected to the connecting member, the upper mounting portion being disposed in a generally fixed position relative to the connecting member when the basketball assembly is in the use position and when the basketball assembly is in the collapsed position;

at least one brace connected to the rim;

a lower mounting portion securely connected to the brace in a generally fixed position, the lower mounting portion being generally aligned in the same plane with the upper mounting portion when the basketball assembly is in the use position and when the basketball assembly is in the collapsed position;

a collapsed position in which the upper and lower mounting portions are disposed proximate to each other to facilitate packaging, the lower mounting portion being sized and configured to be connected to the upper mounting portion in the collapsed position by a fastener to secure the lower mounting portion in the collapsed position; and a playing position in which the upper mounting portion is spaced apart from the lower mounting portion, and the upper mounting portion and the lower mounting portion are sized and configured to allow the rim assembly to be used to play basketball, the lower mounting portion being connected to the brace in the collapsed position and in the playing position.

14. The basketball rim assembly as in claim 13, further comprising a support structure that is sized and configured to be connected to the upper mounting portion and the lower mounting portion when the basketball rim assembly is in the playing position.

15. The basketball rim assembly as in claim 13, further comprising one or more mounting holes in the upper mounting portion and one or more mounting holes in the lower mounting portion; and further comprising a support structure with one or more upper mounting holes and one or more lower mounting holes, the mounting holes in the upper mounting portion being sized and configured to be aligned with the upper mounting holes in the support structure and the mounting holes in the lower mounting portion being sized and configured to be aligned with the lower mounting holes in the support structure when the basketball rim assembly is in the playing position.

16. The basketball rim assembly as in claim 13, further comprising a basketball backboard with one or more upper mounting holes and one or more lower mounting holes; and further comprising one or more mounting holes in the upper mounting portion and one or more mounting holes in the lower mounting portion, the upper mounting holes in the basketball backboard being sized and configured to be aligned with the mounting holes in the upper mounting portion and the lower mounting holes in the basketball backboard being sized and configured to be aligned with the mounting holes in the lower mounting portion when the basketball rim assembly is in the playing position.

17. A collapsible basketball rim assembly that is movable between a collapsed position and a use position, the collapsible basketball rim assembly comprising:

a rim;

a connecting member connected to the rim;

an upper mounting portion extending downwardly at approximately a 90° angle and being integrally formed with the connecting member as part of a unitary, one-piece structure, the upper mounting portion being disposed in a fixed position relative to the connecting member when the basketball rim assembly is in the use position and when the basketball rim assembly is in the collapsed position; and a lower mounting portion securely connected in a generally fixed position to the rim, the lower mounting portion and the upper mounting portion being generally aligned in the same plane when the basketball rim assembly is in the use position and when the basketball rim assembly is in the collapsed position;

wherein the collapsed position the upper and lower mounting portions disposed proximate to each other to facilitate packaging, the lower mounting portion being sized and configured to be connected to the upper mounting portion in the collapsed position by a fastener to secure the lower mounting portion in the collapsed position; and wherein the playing position includes the upper mounting portion spaced apart from the lower mounting portion, the upper mounting portion and the lower mounting portion being sized and configured to allow the rim assembly to be used to play basketball, the lower mounting portion being connected to the rim in the collapsed position and in the playing position.

18. The collapsible basketball rim assembly as in claim 17, further comprising at least one brace connecting the lower mounting portion and the rim.

19. The collapsible basketball rim assembly as in claim 18, wherein the lower mounting portion includes an elongated portion of the at least one brace.

20. The collapsible basketball rim assembly as in claim 17, wherein the upper mounting portion includes a flange.

21. The collapsible basketball rim assembly as in claim 17, wherein the lower mounting portion includes a bracket.

22. The collapsible basketball rim assembly as in claim 17, further comprising a mounting plate including a first portion that is sized and configured to be attached to the upper mounting portion and a second portion that is sized and configured to be attached to the lower mounting portion when the basketball rim assembly is in the playing position.

23. The collapsible basketball rim assembly as in claim 17, further comprising a fastener that connects the upper mounting portion and the lower mounting portion when the basketball rim assembly is in the collapsed position.

24. The collapsible basketball rim assembly as in claim 17, wherein the upper mounting portion and the lower mounting portion are generally aligned in the same plane when the basketball rim assembly is in the playing position; and wherein the upper mounting portion and the lower mounting portion are generally not in the same plane when the basketball rim assembly is in the collapsed position.

25. The collapsible basketball rim assembly as in claim 17, wherein the upper mounting portion and the lower mounting portion at least partially overlap when the basketball rim assembly is in the collapsed position.

* * * * *

UNITED STATES PATENT AND TRADEMARK OFFICE

CERTIFICATE OF CORRECTION

PATENT NO. : 7,195,571 B2
APPLICATION NO. : 10/357655
DATED : March 27, 2007
INVENTOR(S) : S. Curtis Nye It is certified that error appears in the above-identified patent and that said Letters Patent is hereby corrected as shown below:

Column 2
Line 16, before “shipping”, change “that” to --than--

Claim 17
Column 10
Line 64, after “wherein”, insert --in--
Line 64, after “position”, insert --,--
Line 65, after “portions”, insert --are--

Signed and Sealed this

Twenty-fifth Day of September, 2007

JON W. DUDAS
*Director of the United States Patent and Trademark Office*